US010603249B2

(12) United States Patent
Fang et al.

(10) Patent No.: US 10,603,249 B2
(45) Date of Patent: Mar. 31, 2020

(54) COMPRESSIBLE PACIFIER

(71) Applicant: Munchkin, Inc., Van Nuys, CA (US)

(72) Inventors: Ruth Hsin-Ju Fang, San Diego, CA (US); Thomas E Birkert, West Hills, CA (US); Mark Gerard Tebbe, Ventura, CA (US)

(73) Assignee: Munchkin, Inc., Van Nuys, CA (US)

( * ) Notice: Subject to any disclaimer, the term of this patent is extended or adjusted under 35 U.S.C. 154(b) by 126 days.

(21) Appl. No.: 15/904,303

(22) Filed: Feb. 23, 2018

(65) Prior Publication Data

US 2018/0235846 A1 Aug. 23, 2018

Related U.S. Application Data

(60) Provisional application No. 62/462,883, filed on Feb. 23, 2017.

(51) Int. Cl.
*A61J 17/00* (2006.01)

(52) U.S. Cl.
CPC ..... *A61J 17/001* (2015.05)

(58) Field of Classification Search
CPC ..... A61J 17/001; A61J 17/008; A61J 17/00; A45F 5/02
See application file for complete search history.

(56) References Cited

U.S. PATENT DOCUMENTS

2014/0257387 A1* 9/2014 Saxton ..... A61J 17/008 606/236
2014/0257388 A1* 9/2014 Dunn ..... A45F 5/02 606/236
2018/0256454 A1* 9/2018 Badger ..... A61J 17/008

* cited by examiner

*Primary Examiner* — George J Ulsh
(74) *Attorney, Agent, or Firm* — Robert Z. Evora, Esq.

(57) ABSTRACT

A compressible pacifier is described having a flexible neck portion connecting a nipple to a base portion. The flexible neck portion allows for the nipple to be extended for use as needed, and compressed within the planar surface of the base portion when the pacifier is not in use or is being transported.

20 Claims, 3 Drawing Sheets

SECTION B-B

COMPRESSIBLE PACIFIER

CROSS REFERENCE TO RELATED APPLICATIONS

This application claims priority to U.S. Provisional Patent Application Ser. No. 62/462,883, filed Feb. 23, 2017; the content of which is hereby incorporated by reference herein in its entirety into this disclosure.

TECHNICAL FIELD

The subject disclosure relates generally to the field of pacifiers. In particular, the subject disclosure relates to compressible pacifiers.

BACKGROUND

Pacifiers are one of the most commonly used tools by parents worldwide to ease the stress or anxiety of an infant or toddler. Although pacifiers have many shapes and configurations, the common features include a nipple portion which is inserted into the mouth of the infant or toddler, and a base portion, which supports the base of the nipple portion and rests on the outside of the infant's or toddler's mouth. Although extremely useful, the odd configuration of the standard pacifier creates a bulky geometry which makes them somewhat awkward to carry if not in use. Further, most pacifiers do not have their own container therefore opening the possibility of having to carry a pacifier without a protective housing which would expose the nipple to various contaminants.

SUMMARY OF THE SUBJECT DISCLOSURE

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

In one exemplary embodiment, the present subject disclosure is a pacifier. The pacifier includes a nipple portion; a base portion having a planar surface; and a compressible neck portion having flexible folds, and connecting the nipple portion to the base portion; wherein the compressible neck portion allows for the nipple portion to be positioned outside the planar surface of the base portion in an extended position, and to cross into the planar surface of the base portion in a compressed position.

In another exemplary embodiment, the present subject disclosure is a pacifier. The pacifier includes a nipple portion; a base portion having a planar surface and an outer circumference; an outer ring positioned beyond the outer circumference of the base portion; and a compressible neck portion having flexible folds, connecting the nipple portion to the base portion; wherein the neck portion controls the movement of the nipple between an extended nipple position and a compressed nipple position, and maintains the nipple portion outside the planar surface of the base portion in the extended nipple position, and allows for the nipple portion to cross into the planar surface of the base portion in a compressed nipple position.

In yet another exemplary embodiment, the present subject disclosure is a pacifier. The pacifier includes a nipple portion; a base portion having a planar surface and an outer circumference; a substantially rigid outer ring positioned beyond the outer circumference of the base portion; and a compressible neck portion having flexible folds connecting the nipple portion to the base portion; wherein the neck portion controls the movement of the nipple between an extended nipple position and a compressed nipple position, and maintains the nipple portion outside the planar surface of the base portion in the extended nipple position, and inverts to allows for the nipple portion to cross into the planar surface of the base portion in a compressed nipple position.

While various aspects, features, or advantages of the subject disclosure are illustrated in reference to pacifiers, such aspects and features also can be exploited in various other pacifier configurations.

To the accomplishment of the foregoing and related ends, the subject disclosure, then, comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present subject disclosure will now be described in greater detail with reference to the figures. As shown in the figures, an exemplary embodiment of the present subject disclosure is shown in the extended (FIGS. 1A-1E, 2A-2B) and the compressed (FIGS. 3A-3D) positions.

Figure 1A:
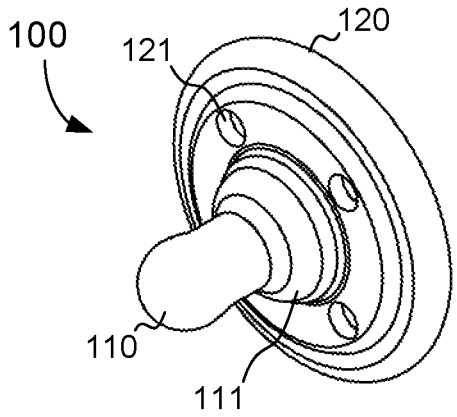
FIG. 1A illustrates a front perspective view of the extended position of a compressible pacifier, according to an exemplary embodiment of the present subject disclosure.
Figure 1B:
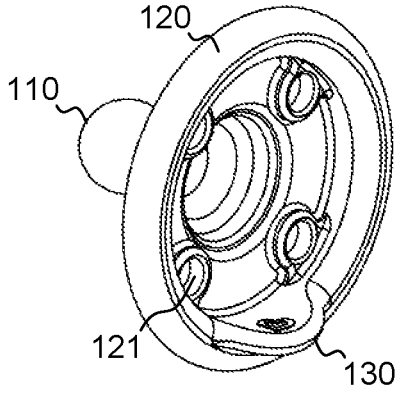
FIG. 1B illustrates a back perspective view of the extended position of a compressible pacifier, according to an exemplary embodiment of the present subject disclosure.
Figure 3A:
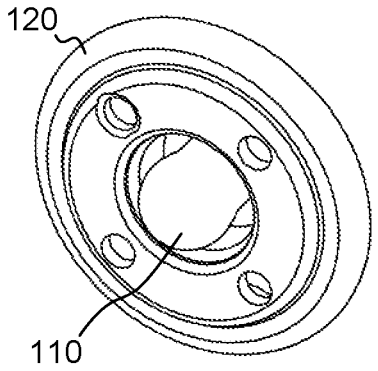
FIG. 3A illustrates a front perspective view of the compressed position of a compressible pacifier, according to an exemplary embodiment of the present subject disclosure.

As shown throughout the figures, the compressible pacifier 100 has a nipple portion 110 which extends from a compressible neck 111. Neck 111 has a series of accordion-like flexible folds 111A. The flexible folds 111A are positioned between the nipple portion 110 and the base portion 112. The flexible folds may be two or more pre-manufactured folding lines and comprise a pliable and resilient material. The flexible folds 111A in the neck 111 allow the nipple 110 to extend outward when in use (FIG. 1A), and be compressed inward when being stored or carried (FIG. 3A). As shown in FIG. 3A, flexible folds 111A in the neck 111 is the portion of the pacifier 100 which allows the pacifier 100 to go from an extended nipple position (FIG. 1A) to a low profile tucked nipple position (FIG. 3A), and back to the extended nipple position (FIG. 1A).

Figure 2A:
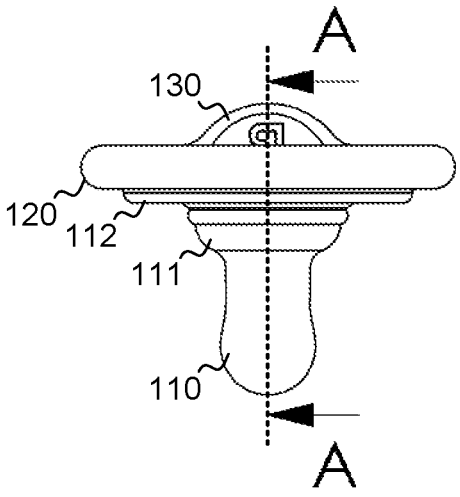
FIG. 2A illustrates a side view of the extended position of a compressible pacifier with planar section A-A symmetrically dividing the pacifier in half, according to an exemplary embodiment of the present subject disclosure.
Figure 2B:
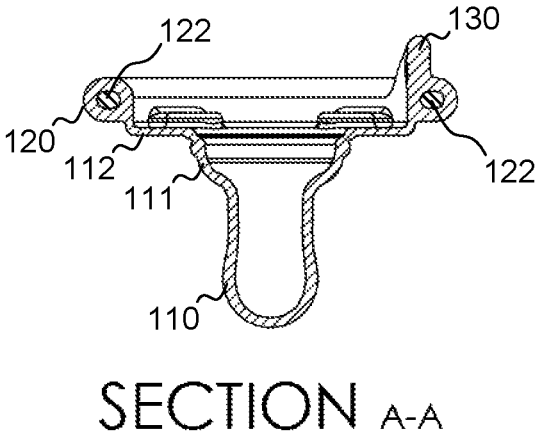
FIG. 2B illustrates a cut view of the extended position of a compressible pacifier along section A-A, according to an exemplary embodiment of the present subject disclosure.

An outer, rigid ring 120 encircles the outer portion of the pacifier 100 and provides a stable base for the movement of the neck 111 during extension and compression of the nipple 110. As shown in FIG. 2B, the rigid ring 120 is given its rigidity by having an interior solid member 122. Interior solid member 122 may be metal, hardened plastic, or some other material or combination of materials which would provide enough rigidity to substantially prevent the deformation of the rigid ring 120 when the nipple 110 is extended or compressed. The rigid ring 120 may be comprised of an overmolded or co-molded silicone around the interior solid ring member 122 structure. Other techniques may also be used.

One or more apertures 121 on the base/body of the pacifier 100 serve as air holes and allow for an infant to breath during the suckling on the pacifier, and preventing the pacifier 100 from getting stuck on the infant's face. The apertures 121 shown in the figures are positioned equally at 90 degrees just outside of the flexible neck portion 111. However, there may be more or fewer apertures 121 used and they may be placed at various spots on the body of the pacifier 100 to help the infant in breathing.

A handle 130 extends from the rigid ring 120 to allow for easier handling of the pacifier 100 by the infant or adult caretaker. Because the pacifier 100 is desired to be low profile, the handle 130 is also low profile and preferably does not extend beyond a total width of the compressed pacifier position. For example, as shown in FIG. 3D, during compression of the pacifier 100, the handle 130 maintains a low profile and stays within the horizontal boundaries of the compressed width of the nipple 110. This minimizes the amount of space needed to store the compressed pacifier 100.

Figure 1C:
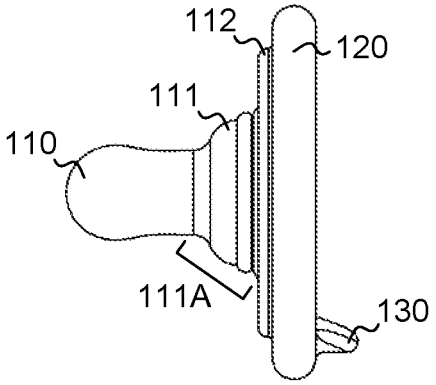
FIG. 1C illustrates a side view of the extended position of a compressible pacifier, according to an exemplary embodiment of the present subject disclosure.
Figure 1D:
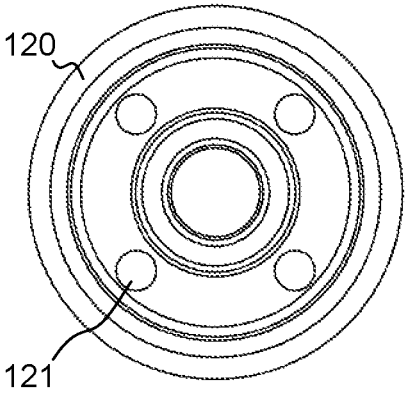
FIG. 1D illustrates a front view of the extended position of a compressible pacifier, according to an exemplary embodiment of the present subject disclosure.
Figure 1E:
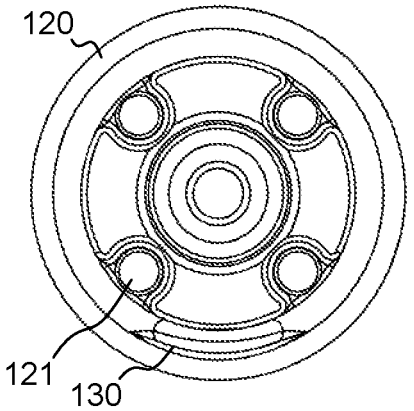
FIG. 1E illustrates a back view of the extended position of a compressible pacifier, according to an exemplary embodiment of the present subject disclosure.
Figure 3B:
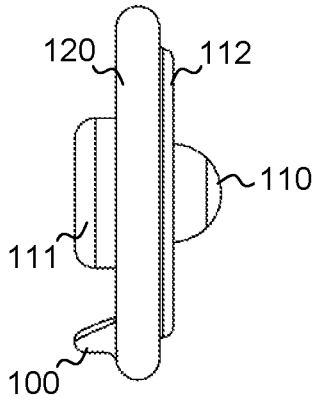
FIG. 3B illustrates a side view of the compressed position of a compressible pacifier, according to an exemplary embodiment of the present subject disclosure.
Figure 3C:
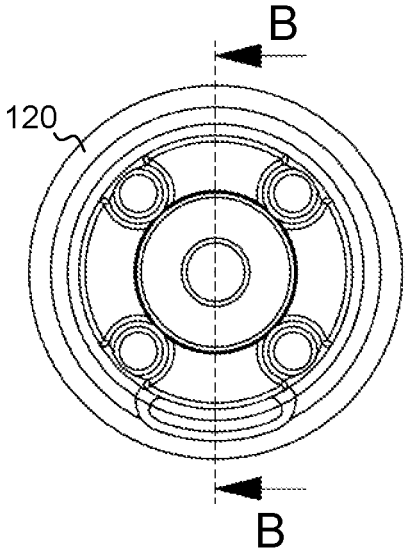
FIG. 3C illustrates a back view of the compressed position of a compressible pacifier with planar section B-B symmetrically dividing the pacifier in half, according to an exemplary embodiment of the present subject disclosure.
Figure 3D:
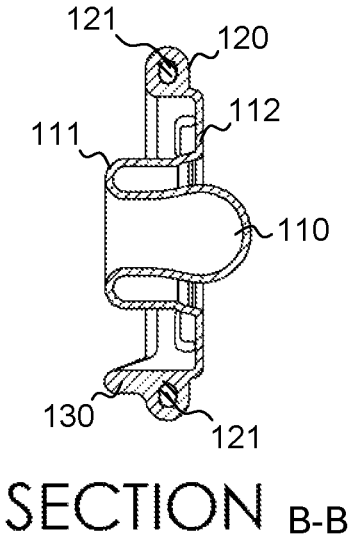
FIG. 3D illustrates a cut view of the extended position of a compressible pacifier along section B-B, according to an exemplary embodiment of the present subject disclosure.

The structural changes made to the pacifier 100 when it is changed from an extended position to a compressed position may be best illustrated when comparing FIG. 1C (extended) to FIG. 3B (compressed). The corresponding cross section along plane A-A is best illustrated from comparing FIG. 2B (extended) to FIG. 3D. In the extended position, the position of the neck 111 extends outward from the base portion 112. As shown in FIGS. 1C and 3B, the base portion 112 remains in the relatively same position whether the nipple 110 is extended or compressed. Thus, the base portion 112 provides the platform on which the neck 111 extends or compresses. The base portion 112 extends slightly above the planar surface of the rigid ring 120, as shown in FIG. 3B. When the nipple is compressed, the flexible folds 111A in the flexible neck 111 extends inwards toward the interior of the plane of the rigid ring 120. In other words, the neck 111 becomes concaved, and is inverted, resulting in a position that is substantially within the plane created by the rigid ring 120. This compression brings the nipple 110 closer to the base portion 112 and planar ring 120. The interior solid member 122 then provides a type of protective shield over the circumference of the nipple 110 to prevent the nipple 110 and neck 111 from getting crushed or caught up in some other object since the nipple 110 and neck 111 are not extended and vulnerable any longer. This is similar to a turtle retracting its neck inside of its shell to protect its face and neck. When the nipple 110 is desired to be used, a gentle push on the retracted neck portion 111 (shown in FIG. 3B) would pop the nipple 110 outward and result in the nipple 110 becoming fully extended (FIG. 1C).

While in the compressed position, the overall pacifier 100 requires a much smaller volume of space than when the nipple is extended. Thus, it is more desirable to compress the nipple 110 when the pacifier 100 is being transported or stored. The pacifier 100 will require less room and therefore a given volume of a container (such as a diaper bag or other carry bag or container) can transport more pacifiers 100.

The pacifier 100 may be constructed of one or more materials which allow the functionalities described herein and shown in the figures. The nipple 110 may be constructed of a softer material than the neck portion 111 so that it is easier on the gums and teeth of the infant. The neck portion 111 may be made of a stiffer (yet flexible) material than the nipple 110 to allow for compression when needed but having enough rigidity to maintain a desired position of the nipple 110 (extended or compressed) until a given amount of force is applied to change the position. The rigid ring 120 may be constructed of a material more rigid than the nipple 110 to provide for structural stability of the pacifier 100.

The internal solid member 122 is a hardened material which is used to provide a substantially inflexible rigid ring 120. Without the internal solid member 122, the rigid ring 120 would be flexible and make it more difficult to maintain its structural position when the nipple 110 is extended or compressed. All of the surfaces of the pacifier 100 should be smooth to allow for easy handling and cleaning. The absence of any sharp edges also minimizes the risk of an infant being hurt during handling of the pacifier 100.

The present subject matter may be used in conjunction with low profile containers or other containers which may be used to store or transport the present pacifiers 100. The ability to compress a pacifier 100 as described in the present disclosure is desirable as it allows for easier storage and handling of these necessary infant products, particularly because a parent may have several to a dozen or more pacifiers 100 to carry or transport along with the infant. The less space they occupy, the easier they will be to transport.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The illustrations and examples provided herein are for explanatory purposes and are not intended to limit the scope of the appended claims. It will be recognized by those skilled in the art that changes or modifications may be made to the above described embodiment without departing from the broad inventive concepts of the subject disclosure. It is understood therefore that the subject disclosure is not limited to the particular embodiment which is described, but is intended to cover all modifications and changes within the scope and spirit of the subject disclosure.

What is claimed is:

1. A pacifier, comprising:

a nipple portion;

a base portion having a planar surface; and a compressible neck portion having flexible folds, and connecting the nipple portion to the base portion; and an outer ring positioned beyond the outer circumference of the base portion and is substantially rigid as compared to the nipple portion, compressible neck portion, and base portion, the outer ring having an interior rigid insert that substantially prevents flexibility of the outer ring, wherein the compressible neck portion allows for the nipple portion to be positioned outside the planar surface of the base portion in an extended position, and to cross into the planar surface of the base portion in a compressed position.

2. The pacifier of claim 1, further comprising an aperture in the base portion.

3. The pacifier of claim 1, further comprising a handle extending from the base portion.

4. The pacifier of claim 3, wherein the handle is low profile.

5. The pacifier of claim 4, wherein the handle stays within a width of the nipple when the nipple is compressed.

6. The pacifier of claim 1, wherein the compressible neck portion controls the movement of the nipple between the extended position and the compressed position.

7. The pacifier of claim 6, wherein the compressible neck portion inverts between movement of the extended to compressed positions.

8. The pacifier of claim 6, wherein the neck portion becomes concaved between movement of the extended to compressed positions.

9. The pacifier of claim 1, wherein the interior rigid insert is metallic.

10. The pacifier of claim 1, wherein the interior rigid insert is hardened plastic.

11. A pacifier, comprising:

a nipple portion;

a base portion having a planar surface and an outer circumference;

an outer ring having an interior rigid insert that substantially reduces flexibility of the outer ring and positioned beyond the outer circumference of the base portion; and a compressible neck portion having flexible folds connecting the nipple portion to the base portion, wherein the neck portion controls the movement of the nipple portion between an extended nipple position and a compressed nipple position, and maintains the nipple portion outside the planar surface of the base portion in the extended nipple position, and allows for the nipple portion to cross into the planar surface of the base portion in a compressed nipple position.

12. The pacifier of claim 11, further comprising an aperture in the base portion.

13. The pacifier of claim 11, further comprising a handle extending from the base portion.

14. The pacifier of claim 13, wherein the handle is low profile.

15. The pacifier of claim 14, wherein the handle stays within a width of the nipple when compressed.

16. A pacifier, comprising:

a nipple portion;

a base portion having a planar surface and an outer circumference;

an outer ring positioned beyond the outer circumference of the base portion and having an internal insert that increases the rigidity of the outer ring; and a compressible neck portion having flexible folds connecting the nipple portion to the base portion.

17. The pacifier of claim 16, further comprising a low profile handle extending from the base portion which stays within a width of the nipple when compressed.

18. The pacifier recited in claim 16, wherein the neck portion:

controls the movement of the nipple portion between an extended nipple position and a compressed nipple position;

maintains the nipple portion outside the planar surface of the base portion in the extended nipple position; and inverts to allow for the nipple portion to cross into the planar surface of the base portion in a compressed nipple position.

19. The pacifier recited in claim 16, wherein the internal insert is plastic.

20. The pacifier of claim 16, further comprising a handle extending from the base portion.

* * * * *